US012241329B1

(12) United States Patent
Bridwell et al.

(10) Patent No.: US 12,241,329 B1
(45) Date of Patent: Mar. 4, 2025

(54) AUTOMATIC SLIP-STYLE CASING HANGER FOR USE WITH SURFACE WELLHEADS

(71) Applicant: FMC Technologies, Inc., Houston, TX (US)

(72) Inventors: Richard Bridwell, Houston, TX (US); Brian Baca, Houston, TX (US)

(73) Assignee: FMC Technologies, Inc., Houston, TX (US)

( * ) Notice: Subject to any disclaimer, the term of this patent is extended or adjusted under 35 U.S.C. 154(b) by 0 days.

(21) Appl. No.: 18/489,267

(22) Filed: Oct. 18, 2023

(51) Int. Cl.
*E21B 33/04* (2006.01)

(52) U.S. Cl.
CPC ..... *E21B 33/0422* (2013.01)

(58) Field of Classification Search
CPC ..... E21B 33/04; E21B 33/0422
See application file for complete search history.

(56) References Cited

U.S. PATENT DOCUMENTS 2,553,838 A * 5/1951 Allen ..... E21B 33/0422 248/354.1
2,880,806 A 4/1959 Davis
3,011,806 A * 12/1961 Allen ..... F16L 39/005 285/123.8
3,068,027 A * 12/1962 Lewis ..... E21B 33/0422 285/123.8
3,192,592 A * 7/1965 Yancey ..... E21B 33/04 285/123.8
3,438,654 A * 4/1969 Jackson, Jr. ..... E21B 33/0422 285/123.7
3,994,517 A * 11/1976 Carmichael ..... E21B 33/0422 285/123.7
4,353,560 A * 10/1982 Tohill ..... F16J 15/28 277/621
4,494,778 A * 1/1985 Johnson ..... E21B 33/0422 285/123.8
4,790,379 A * 12/1988 Vanderford, Jr. ... E21B 33/0422 166/208

(Continued)

FOREIGN PATENT DOCUMENTS

CA 2185836 C * 1/2001 ..... E21B 19/00
JP S5243702 A 4/1977
WO WO-2013158031 A1 * 10/2013 ..... E21B 33/0422

OTHER PUBLICATIONS

International Search Report issued in International Application No. PCT/US2024/051271 dated Dec. 9, 2024 (6 pages).

*Primary Examiner* — Jennifer H Gay
(74) *Attorney, Agent, or Firm* — Osha Bergman Watanabe & Burton LLP

(57) ABSTRACT

A casing hanger apparatus includes an upper ring, a lower ring, and a packing element positioned between the upper ring and the lower ring. The packing element has an annular body with a wedge-shaped cross-sectional geometry. Bi-directional pressure intensification (BPI) pins are arranged around the casing hanger in an angularly spaced apart configuration, where the BPI pins extend axially from the upper ring through holes in the packing element to the lower ring. In some casing hanger apparatuses, a bushing member is positioned axially between the upper ring and the lower ring, where the BPI pins also extend axially through the bushing member.

19 Claims, 8 Drawing Sheets

(56) References Cited

U.S. PATENT DOCUMENTS

| | | | | |
|---|---|---|---|---|
| 5,031,695 | A * | 7/1991 | Cain | E21B 33/0422 166/208 |
| 5,342,066 | A * | 8/1994 | Henley | F16J 15/128 166/208 |
| 5,799,730 | A * | 9/1998 | Lam | E21B 33/0422 166/75.14 |
| 6,488,084 | B1 * | 12/2002 | Borak, Jr. | E21B 33/0422 166/208 |
| 2003/0042027 | A1 | 3/2003 | Lang et al. | |
| 2014/0131954 | A1 * | 5/2014 | Koleilat | F16J 15/068 277/336 |
| 2024/0159121 | A1 * | 5/2024 | Shamov | E21B 33/0422 |

* cited by examiner

AUTOMATIC SLIP-STYLE CASING HANGER FOR USE WITH SURFACE WELLHEADS

BACKGROUND

In oil and gas well completions, a casing string may be run downhole before being cemented in place. Casing may provide protection and isolation from formations adjacent to the wellbore. Casing generally consists of long lengths of steel pipe which are threaded together and are run downhole. A casing hanger is a subassembly of the wellhead, which supports casing after it is run into the wellbore and usually incorporates a packing element to isolate the casing annulus from upper wellhead components.

Two common types of casing hangers exist: slip-style and mandrel. Mandrel casing hangers are threaded on to the end of the casing while slip-style casing hangers grip the outside of the casing. Both types of casing hangers suspend the weight and load of the casing, center the casing in the wellbore, provide a seal in the casing annulus, and allow for testing of connections.

Casing strings may weigh up to hundreds of thousands of pounds which accordingly places a significant amount of stress on the components of the casing hanger. In addition, pressure in the wellbore adds to these stresses. Therefore, specially designed casing hanger components are necessary to ensure the performance and longevity of the apparatus.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

In one aspect, embodiments disclosed herein relate to a casing hanger apparatus, including at least an upper ring and a lower ring. The casing hanger also includes a packing element having a wedge-shaped cross-sectional geometry and extending annularly between the upper ring and the lower ring, and bi-directional pressure intensification (BPI) pins arranged around the casing hanger in an angularly spaced apart configuration. The BPI pins extend axially from the upper ring through holes in the packing element to the lower ring.

In another aspect, embodiments disclosed herein relate to a casing hanger apparatus including at least two rings. The casing hanger also includes at least one bi-directional pressure intensification (BPI) pin arranged around the casing hanger and extending axially between an upper ring and a lower ring, where each BPI pin has a male end and a female end. A bushing member may be positioned axially between the upper ring and the lower ring. Additionally, a packing element having an annular body with a wedge-shaped cross-sectional geometry may be positioned axially between the upper ring and the bushing member. Each BPI pin may extend axially through the bushing member and the packing element.

Other aspects and advantages of the claimed subject matter will be apparent from the following description and the appended claims.

BRIEF DESCRIPTION OF DRAWINGS

The following is a description of the figures in the accompanying drawings. In the drawings, identical reference numbers identify similar elements or acts. The sizes and relative positions of elements in the drawings are not necessarily drawn to scale. For example, the shapes of various elements and angles are not necessarily drawn to scale, and some of these elements may be arbitrarily enlarged and positioned to improve drawing legibility. Further, the particular shapes of the elements as drawn are not necessarily intended to convey any information regarding the actual shape of the particular elements and have been solely selected for ease of recognition in the drawing.

DETAILED DESCRIPTION

Figure 1:
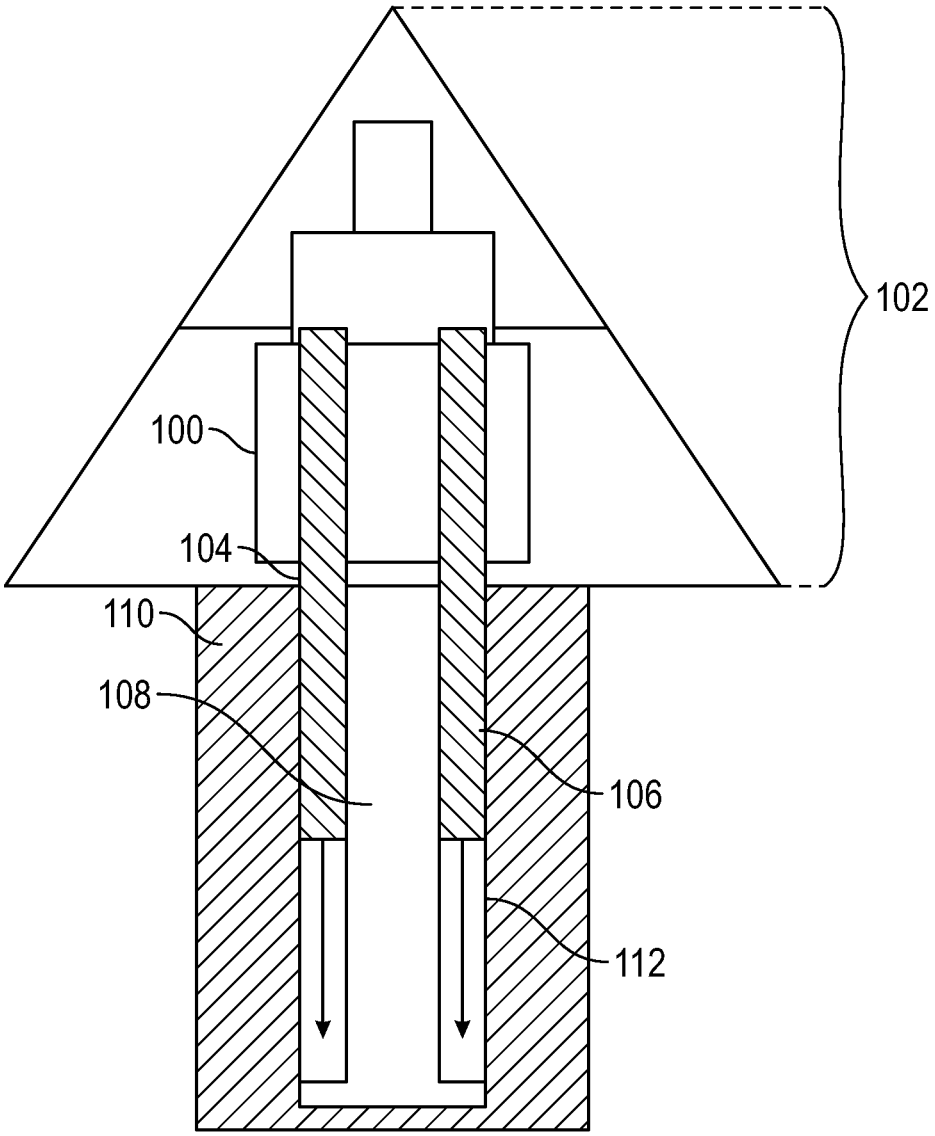
FIG. 1 is a generalized schematic illustrating a system for hanging casing as described in one or more embodiments herein.

In the following detailed description, certain specific details are set forth in order to provide a thorough understanding of various disclosed implementations and embodiments. However, one skilled in the relevant art will recognize that implementations and embodiments may be practiced without one or more of these specific details, or with other methods, components, materials, and so forth. In other instances, well known features or processes associated with the hydrocarbon production systems have not been shown or described in detail to avoid unnecessarily obscuring descriptions of the implementations and embodiments. For the sake of continuity, and in the interest of conciseness, same or similar reference characters may be used for same or similar objects in multiple figures.

Throughout the application, ordinal numbers (e.g., first, second, third, etc.) may be used as an adjective for an element (i.e., any noun in the application). The use of ordinal numbers is not to imply or create any particular ordering of the elements nor to limit any element to being only a single element unless expressly disclosed, such as using the terms "before," "after," "single," and other such terminology. Rather, the use of ordinal numbers is to distinguish between the elements. By way of an example, a first element is distinct from a second element, and the first element may encompass more than one element and succeed (or precede) the second element in an ordering of elements.

Embodiments disclosed herein relate generally to a casing hanger, which acts to support casing by suspending the weight and load of the casing string after it is run into the wellbore. A casing hanger generally includes at least one metal ring, a sealing element, and pins which extend through the ring and sealing element. Sealing elements described herein may also be referred to as packing elements or packers in the industry.

More particularly, embodiments disclosed herein relate to slip-style casing hangers for use with wellheads. In one or more embodiments, a casing hanger apparatus includes a wedge-style elastomer packing element. In one or more embodiments, the casing hanger apparatus includes pressure intensification pins, which may have the same or different geometries, may contain one or more pieces, or any combination of elements and configurations described herein. The combination of elements in the casing hanger of one or more embodiments improve the overall performance of the casing hanger.

The improved slip-style casing hanger disclosed herein may include a modified packing element, pin, and/or ring elements. In general, the large weight of casing places a significant amount of stress on the components of the casing hanger. The specially designed and modified slip-style casing hanger components of one or more embodiments improves the performance and longevity of the device. The modified slip-style casing hanger components of one or more embodiments may also act to intensify pressure on the packing element to improve the sealing ability of the casing hanger.

Slip-style casing hangers according to embodiments of the present disclosure may be referred to as "automatic," which refers to the ability of the casing hanger to automatically engage the packing element in the casing hanger when energized by the weight of the casing string. A packing element is a sealing device which has a larger initial inner diameter and a smaller initial outer diameter, and when the packing element is axially compressed, the packing element expands radially (to have a relatively smaller inner diameter and a relatively larger outer diameter) to seal inwardly against the casing and/or outwardly against the wellhead equipment in which the casing hanger is installed. In some cases, packing elements are made of a flexible, elastomer material.

In contrast to the flat, disc-style shape of a conventional elastomeric packing element, packing elements according to embodiments of the present disclosure may have a wedge-shaped cross-sectional geometry. The wedge-shaped cross-section geometry will be described further with regards to FIG. 4. The specific arrangement of wedge-shaped elastomer packing elements mated with adjacent members of a casing hanger apparatus of one or more embodiments allows the packing element to be compressed (and radially expanded to contact sealing surfaces) using a relatively lower load than would otherwise be needed with packing elements having other geometries, for example flat, disc-style shapes. Additionally, the mating tapered surfaces between a wedge-shaped packing element and the casing hanger in which the packing element is assembled provides an improved seal energization when pressure is applied to compress the wedge-shaped packing element.

The wedge-shaped packing element of one or more embodiments is solid and has holes spaced angularly around the packing element body to accommodate bi-directional pressure intensification ("BPI") pins according to embodiments of the present disclosure. The holes are formed through the thickness of the packing element, such that the BPI pins may extend axially through the packing element.

Conventional automatic slip-style casing hangers often have bolts and/or simple pins in the assembly. The function of the bolts in conventional casing hangers is to maintain placement of all members of the casing hanger apparatus during installation and use. The function of the pins, which are conventionally all positioned in a single direction relative to the casing hanger, is to reduce packing area and limit the compression of the packing element. Conventional pins or bolts, which do not act as BPI pins and which are used in conventional casing hanger types, are referred to herein as "dummy pins." Dummy pins reduce packing element area and limit the compression of the packing element by bisecting the packing element and by providing a hard stop between the ring elements.

Although BPI pins described in one or more embodiments herein may provide the same retention function as those in conventional casing hangers, that is to maintain placement of members of the apparatus, they provide additional functions as well.

Herein, the term "bi-directional pressure intensification pin" (BPI pin) refers to a pin member of a casing hanger apparatus which provides additional pressure to the packing element when the casing hanger is pressurized from either direction (e.g., when pressure in the well interacts with and compresses the casing hanger). BPI pins therefore improve the sealing quality of the casing hanger apparatus compared to conventional pin members.

FIG. 1 shows a system for hanging casing according to one or more embodiments described herein. A slip-style casing hanger 100 is part of surface equipment 102 of a well, where the casing hanger 100 is placed in the wellhead 101 near the opening of a well 104. When installed, the casing hanger 100 surrounds a string of casing 106. Prior to running the casing 106, a wellbore path 108 is drilled into a formation 110. The casing 106 is then run-in-hole at a location of casing placement 112 within the drilled wellbore path 108.

Figure 2:
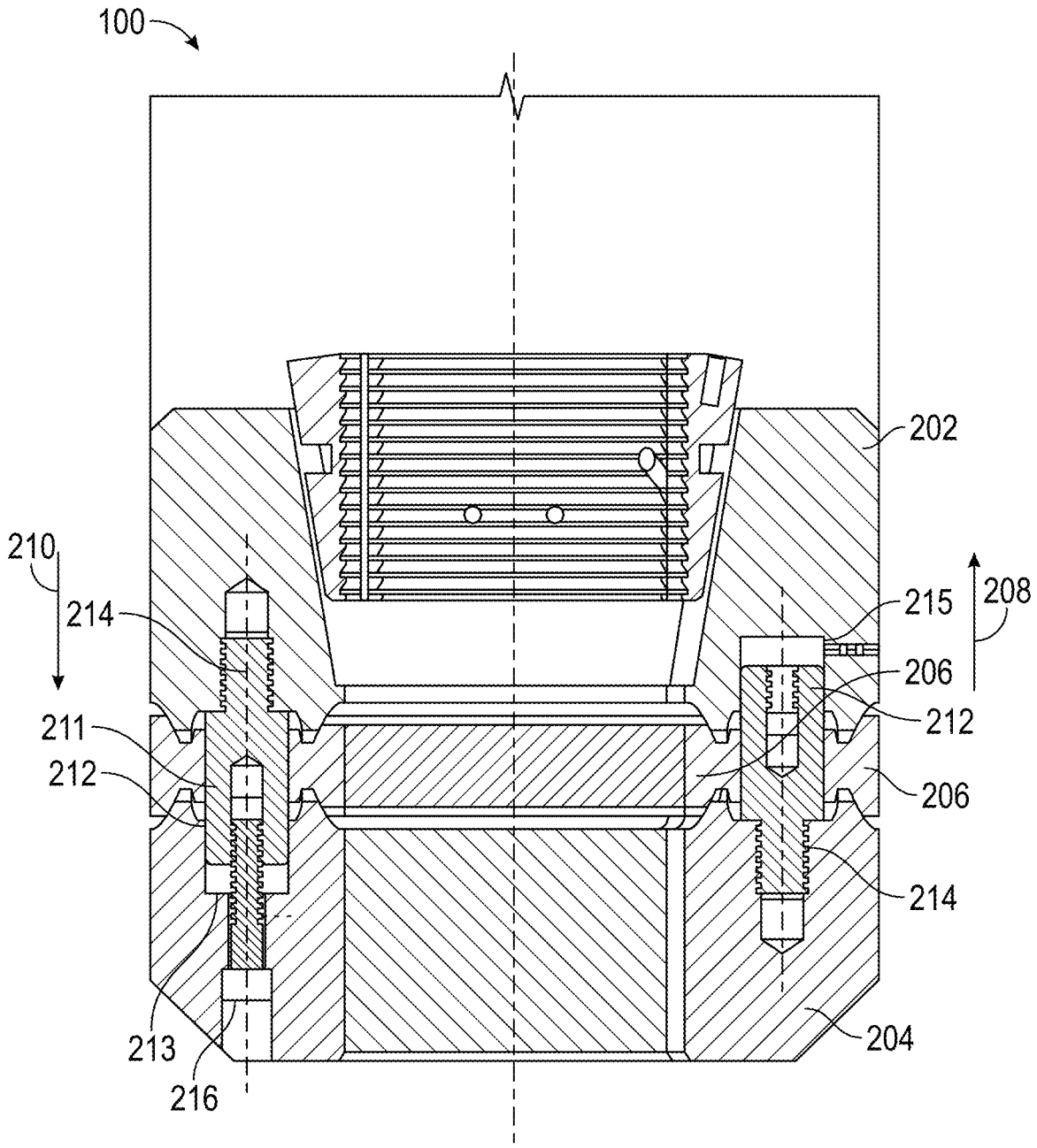
FIG. 2 shows a cross-sectional view of a casing hanger apparatus in accordance with one or more embodiments taken along a plane extending axially along the longitudinal axis of the casing hanger apparatus.

FIG. 2 shows one variation of a slip-style casing hanger apparatus in accordance with one or more embodiments disclosed herein. The slip-style casing hanger 100 contains at least two rings. A lower ring 204 is located at a position nearer to the opening of the well 104 compared to an upper ring 202 when installed in a wellhead. A packing element 206 has an annular body that is positioned axially between the upper ring 202 and the lower ring 204. In one or more embodiments, the packing element 206 has a wedge-shaped cross-sectional geometry, as will be described further in FIG. 4.

According to embodiments of the present disclosure, BPI pins may be installed in alternating axial directions around the annular distance of the casing hanger. As shown in FIG. 2, the BPI pins 211 may extend axially from an upper ring 202 through holes in the packing element 206 to a lower ring 204. Each BPI pin 211 has a male end 214 and a female end 212 at opposite axial ends. With one or more BPI pins 211, a bolt member 216 may be threaded to the female end 212 of the BPI pin to connect the BPI pin 211 to one of the upper ring 202 or lower ring 204, depending on the axial direction of the BPI pin 211.

For example, as shown in FIG. 2, in one or more embodiments, BPI pins 211 are arranged in alternating axial directions—a first direction 208 and a second direction 210—and angularly spaced apart around the casing hanger 100. In the example of FIG. 2, the BPI pins 211 have identical construction, including the male end 214 and female end 212 geometry. In the first direction 208 and the second direction 210, the BPI pins 211 extend axially from the upper ring 202 through the packing element 206 and to the lower ring 204. However, in one or more embodiments, first BPI pin(s) are oriented in a first direction 208, having a female end 212 which faces the upper ring 202 and a male end 214 which faces the lower ring 204. Conversely, neighboring second BPI pin(s) are oriented in a second direction 210, having a female end 212 which faces the lower ring 204 and a male end 214 which faces the upper ring 202.

At least one upper seat 215 may be formed in the upper ring 202, where each upper seat 215 is configured to receive the female end 212 of each first BPI pin 211 oriented in the first direction 208. For example, a female end 212 of a first BPI pin 211 may have a generally cylindrical outer profile, and each upper seat 215 may be a corresponding cylindrical shaped cavity. Similarly, the lower ring 204 in FIG. 2 may have at least one lower seat 213 formed therein that is configured to receive the female end 212 of each BPI pin 211 oriented in the second direction 210. Additionally, a bolt member 216 may be extended through a thickness of the lower ring 204, and through the lower seat 213, to be threaded to the female end 212 of the BPI pins 211 in the second direction 210.

In FIG. 2, by providing the BPI pins 211 in alternating axial directions between the upper and lower rings 202, 204, pressure in the packing element may be intensified through the BPI pins 211 in both (bi) directions. For example, when pressure is applied from the direction of the upper ring 202, the load from the upper ring 202 may be transferred through the BPI pin 211 oriented in the second direction 210. In this scenario, the lower seat 213 in the lower ring 204 and the BPI pin 211 size/shape may be designed such that the female end 212 of the BPI pin 211 does not transfer the load from the upper ring 202 to the lower ring 204. For example, lower seat 213 size/shape and BPI pin size/shape may be designed to where the end face of the BPI pin female end does not contact the lower seat bottom when the packing element is fully compressed. Instead, the load from the upper ring 202 may compress the packing element 206.

Conversely, when pressure is applied from the direction of the lower ring 204, the BPI pins 211 oriented in the first direction 208 absorb the load from the applied pressure by the lower ring 204. In this scenario, the upper seat 215 in the upper ring 202 and the BPI pin 211 size/shape may be designed such that the female end 212 of the BPI pin 211 does not transfer the load from the lower ring 204 to the upper ring 202. For example, upper seat size/shape and BPI pin size/shape may be designed to where the end face of the BPI pin female end does not contact the upper seat ceiling when the packing element is fully compressed. Instead, the load from the lower ring 204 may compress the packing element 206. This bi-directional transfer of load from both the upper and lower rings 202, 204 intensifies the pressure on the packing element 206. In one or more embodiments, the BPI pins are constructed identically for ease of manufacturing.

Figure 3A:
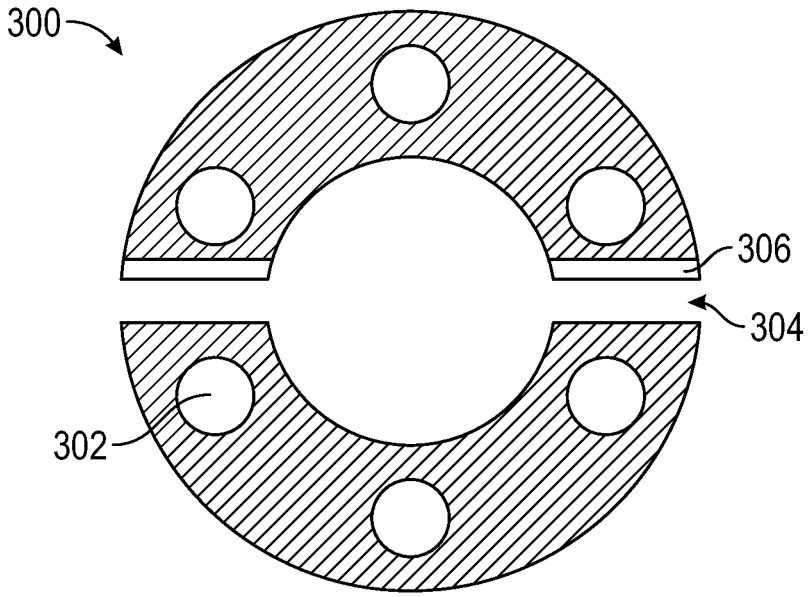
FIGS. 3A and 3B show cross-sections of radial splits in accordance with one or more embodiments.
Figure 3B:
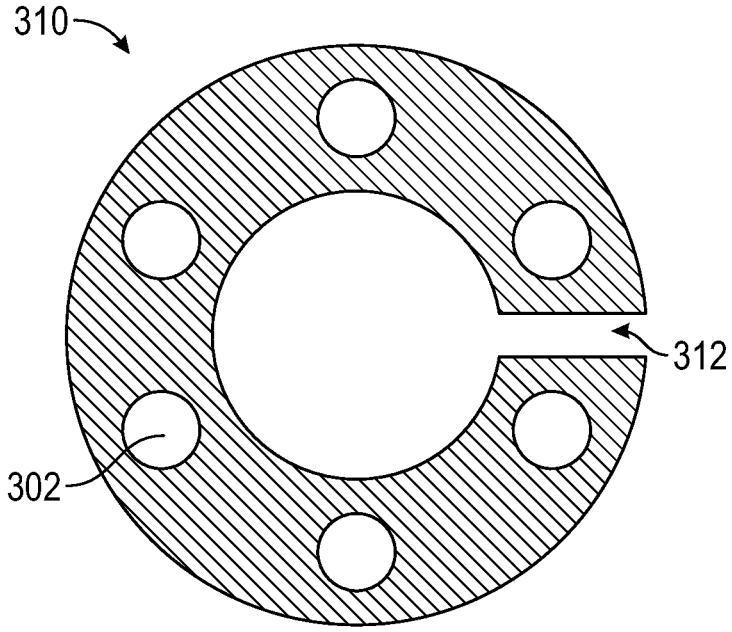

FIGS. 3A and 3B show cross-sections identifying a radial split or splits in casing hanger members in accordance with one or more embodiments. FIG. 3A shows a cross-section of any of the ring members (e.g., upper ring 202 or lower ring 204) described in one or more embodiments herein taken along a plane extending radially through the ring member. The cross-section of a ring member 300 contains holes 302 through which the pins and/or bolts of one or more embodiments may extend. A split 304 in the ring member 300 allows for it to be placed around a casing string, as depicted in the system of FIG. 1. A hinge mechanism 306 on one half of each side of the split 304 latches to the other half to secure each part of the ring member 300 around the casing string. However, other types of connections and/or connectors (e.g., latches) may be used to connect radial segments of an upper or lower ring around a casing string.

FIG. 3B shows a cross-section of a packing element according to one or more embodiments herein along a radial plane through the packing element. The cross-section of a packing element 310 shows holes 302 through which the pins of one or more embodiments may extend. A single split 312 in the packing element 310 may allow for the packing element 310 to be placed around a casing string, as depicted in the system of FIG. 1. In other embodiments, a packing element may extend a continuous annular distance (with no radial splits). In such embodiments, the packing element may be slid around an end of the casing string to be landed on a lower ring.

Figure 4A:
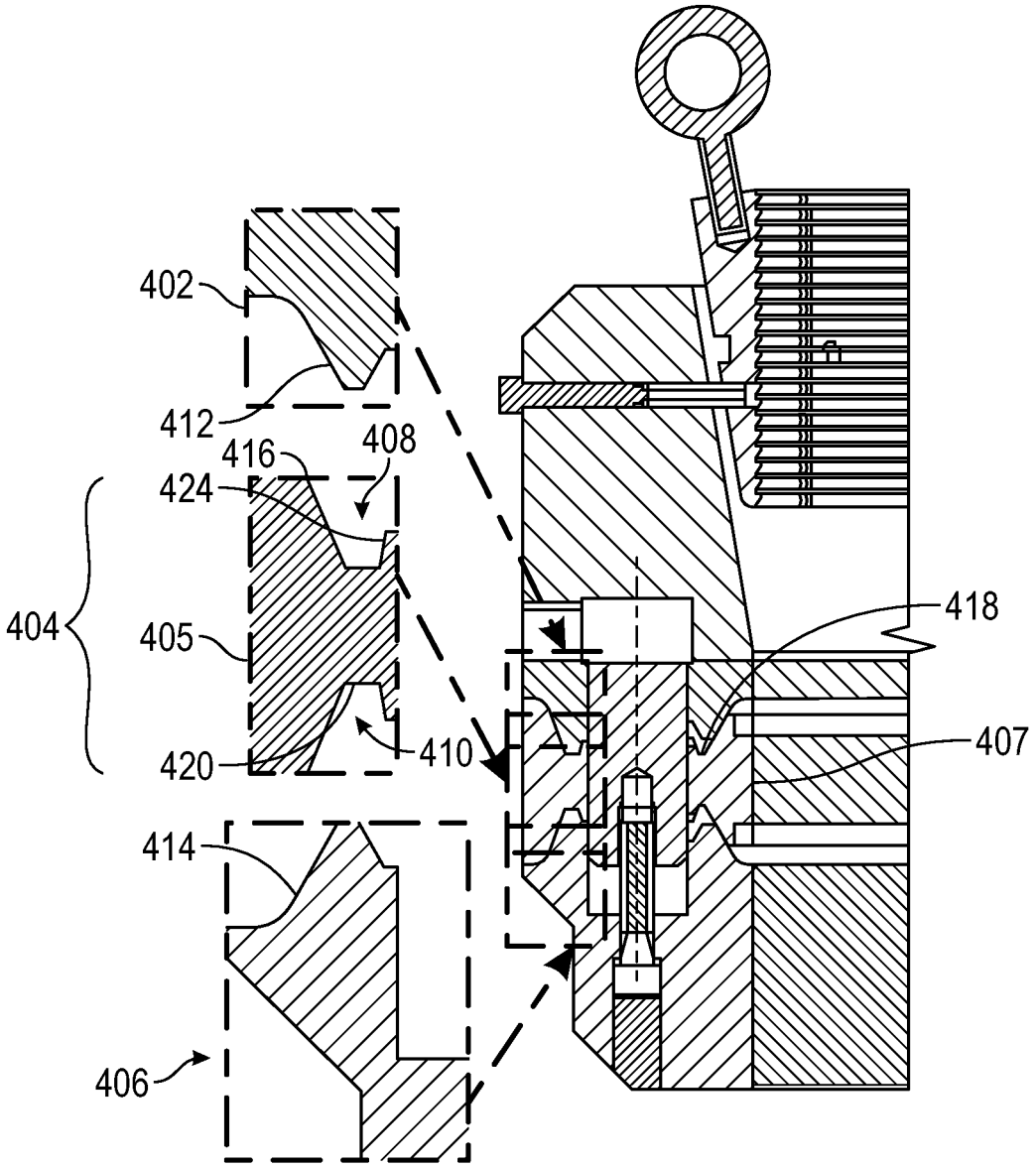
FIGS. 4A-4C show radial cross-sectional views of the elements and corresponding interfacing geometries of an upper and lower ring in accordance with one or more embodiments.
Figure 4B:
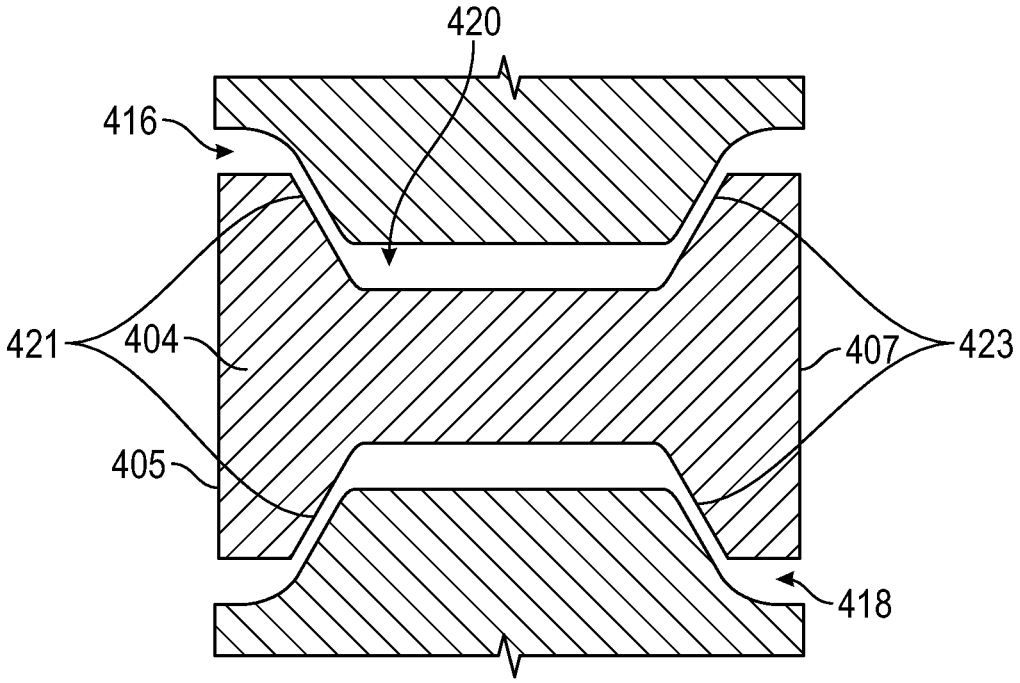
Figure 4C:
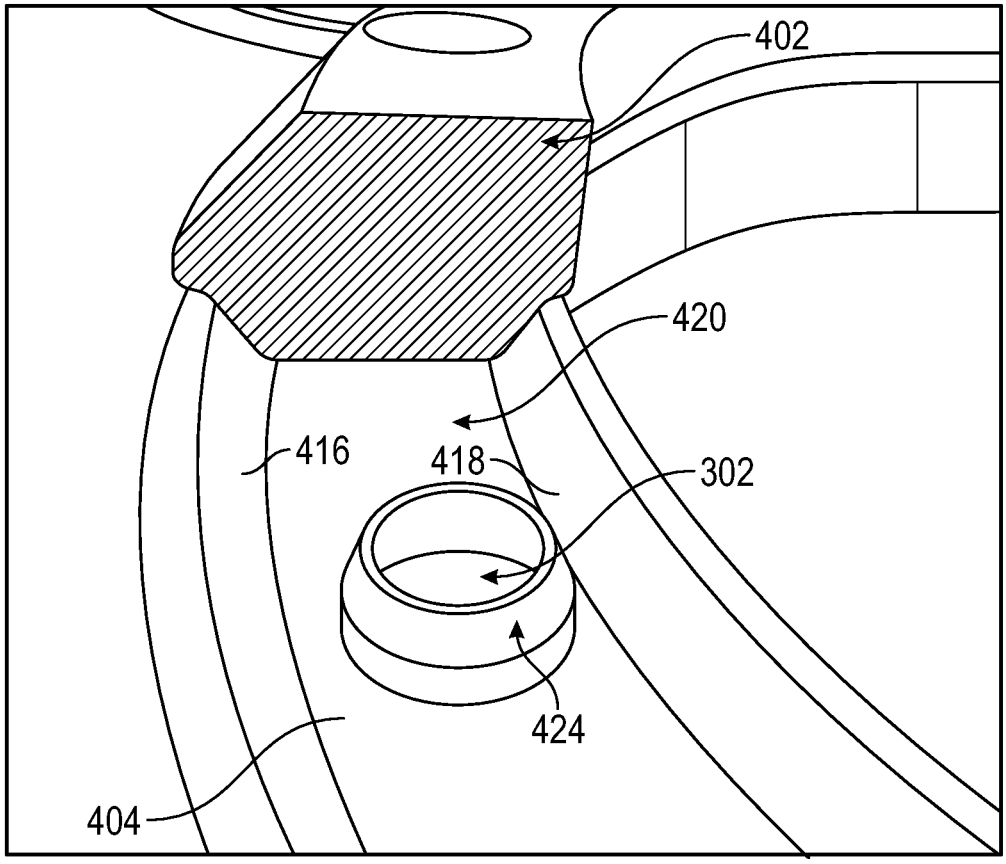

Collectively, FIGS. 4A-4C show partial views of a casing hanger assembly according to embodiments of the present disclosure. The casing hanger 400 includes a wedge-shaped packing element 404 assembled axially between upper and lower rings 402, 406 with corresponding interfacing geometries, where the upper ring 402 interfaces an upper side 408 of the wedge-shaped packing element 404, and the lower ring 404 interfaces a lower side 410 (axially opposite the upper side 408) of the wedge-shaped packing element 404. FIG. 4A shows a cross-sectional view of the casing hanger 400 and selected assembly details taken along a plane extending axially through the casing hanger 400. Particularly, the cross-sectional view in FIG. 4A is taken along an axial plane extending through a BPI pin connection to show details of the BPI pin assembly within upper ring 402, packing element 404, and lower ring 406 components of the casing hanger. FIG. 4B shows a cross-sectional view of the assembly of the upper ring 402, packing element 404, and lower ring 406 taken along an axial plane extending through a portion of the assembly located angularly between BPI pins. FIG. 4C shows a cut-away view of the assembly to show an upper view of a portion of the packing element 404. Particularly, FIG. 4C shows a radial cross-sectional profile of the upper ring 402 interfacing with the packing element 404 in accordance with one or more embodiments.

The wedge-shaped cross-sectional geometry of the packing element 404 includes a neck 420 extending between two oppositely positioned wedged sides (outer wedged side 416 and inner wedged side 418). As best shown in FIG. 4C, the wedge-shaped cross-sectional geometry of the wedged sides may extend angularly around the entire annular distance of the packing element. In such manner, the packing element 404 may have wedge-shaped inner and outer sides.

The outer wedged side 416 has an outer surface 405, where the outer surface 405 defines the outer diameter of the packing element 404, a height measured axially between an upper surface and lower surface, and outer wedge transition surfaces 421 that slope inwardly from the upper and lower surfaces to the neck 420 portion of the packing element 404. The inner wedged side 418 has an inner surface 407 that defines the inner diameter of the packing element 404, a height measured axially between the upper and lower surface, and inner wedge transition surfaces 423 that slope from the upper and lower surfaces to the neck 420.

In one or more embodiments, when the packing element 404 is in an initial, non-compressed (non-energized) position, the inner and outer surfaces 407, 405 may have a cross-sectional profile that is flat (planar), as best shown in FIGS. 4A-B. In other embodiments, the cross-sectional profile of the inner and outer surfaces of a packing element inner surface may be slightly curved (e.g., convex). In some embodiments, when the packing element 404 is axially compressed, the packing element may expand radially inward and outward.

In one or more embodiments, the outer wedged side 416 and the inner wedged side 418 may have symmetrical cross-sectional geometries (e.g., where the outer wedge transition surfaces may have equal but opposite slopes to the inner wedge transition surfaces and where the inner and outer wedges sides have equal heights). In some embodiments, the outer and inner wedged sides may have asymmetrical cross-sectional profiles (e.g., having different heights and/or having transition surfaces with different absolute slope values).

In one or more embodiments, the neck 420 cross-sectional profile may vary along the annular distance of the packing element 404. For example, as best shown in FIG. 4C, pin holes 302 may be formed through the neck portion of the packing element 404 in an angularly spaced apart configuration (e.g., evenly or unevenly spaced) around the annular distance of the packing element 404. A boss 424, which may form a raised collar around the hole 302, may be integrally formed with the packing element 404. In such embodiments, the cross-sectional geometry of the neck 420 intersecting the hole 302 (e.g., such as the cross-section shown in FIG. 4A) may include protrusions extending adjacent to the hole 302 in an axially outward direction from a flat/planar portion of the neck 420. In contrast, in angular portions of the packing element between neighboring holes 302, the cross-sectional geometry of the neck 420 may be planar, where the upper surface and lower surface of the planar portion of the neck 420 may extend linearly between the opposite wedged sides 416, 418.

For example, FIG. 4B shows the cross-sectional profile of the packing element 404 in FIG. 4A taken along an angular portion of the packing element 404 between adjacent pin holes. As shown in FIG. 4B, the outer wedged side 416 and the inner wedged side 418 of the packing element 404 are joined by a neck 420, where the cross-sectional profile of the neck 420 includes a planar upper surface, a planar lower surface, and a height measured between the upper and lower surfaces. In one or more embodiments, the upper and lower surfaces along the neck 420 may be parallel, such that the height of the neck 420 may be uniform along its radial cross-sectional profile. In some embodiments, the neck cross-sectional profile may have a uniform height along the entire annular distance of the packing element 404 (e.g., without any bosses 424 formed around the holes in the packing element). In some embodiments, the cross-sectional profile of the neck 420 may have a non-planar upper and/or lower surface.

In one or more embodiments, the upper ring 402 of the casing hanger 400 may have a lower surface 412 with a geometry that corresponds with the geometry of the packing element 404 upper surface. For example, as shown in FIGS. 4A and 4C, the lower surface of the upper ring 402 has a geometry that corresponds with the packing element 404 upper surface, such that the upper ring 402 interfaces and mates with the packing element 404 at their respective lower and upper surfaces when assembled. Similarly, as shown in FIG. 4A, the lower ring 406 may have an upper surface 414 with a geometry that corresponds with the packing element 404 lower surface, such that the lower ring 406 interfaces and mates with the packing element at their respective upper and lower surfaces when assembled. Such corresponding geometry may include a protruding conical geometry forming bosses 424 around the holes 302 in the packing element 404 and corresponding conical recesses formed in the interfacing surfaces of the upper and/or lower rings 402, 406. Advantageously, the corresponding boss and recess geometry may help to angularly align pin cavities in the upper and/or lower rings 402, 406 with the pin holes 302 in the packing element 404 when assembling the casing hanger.

Figure 5A:
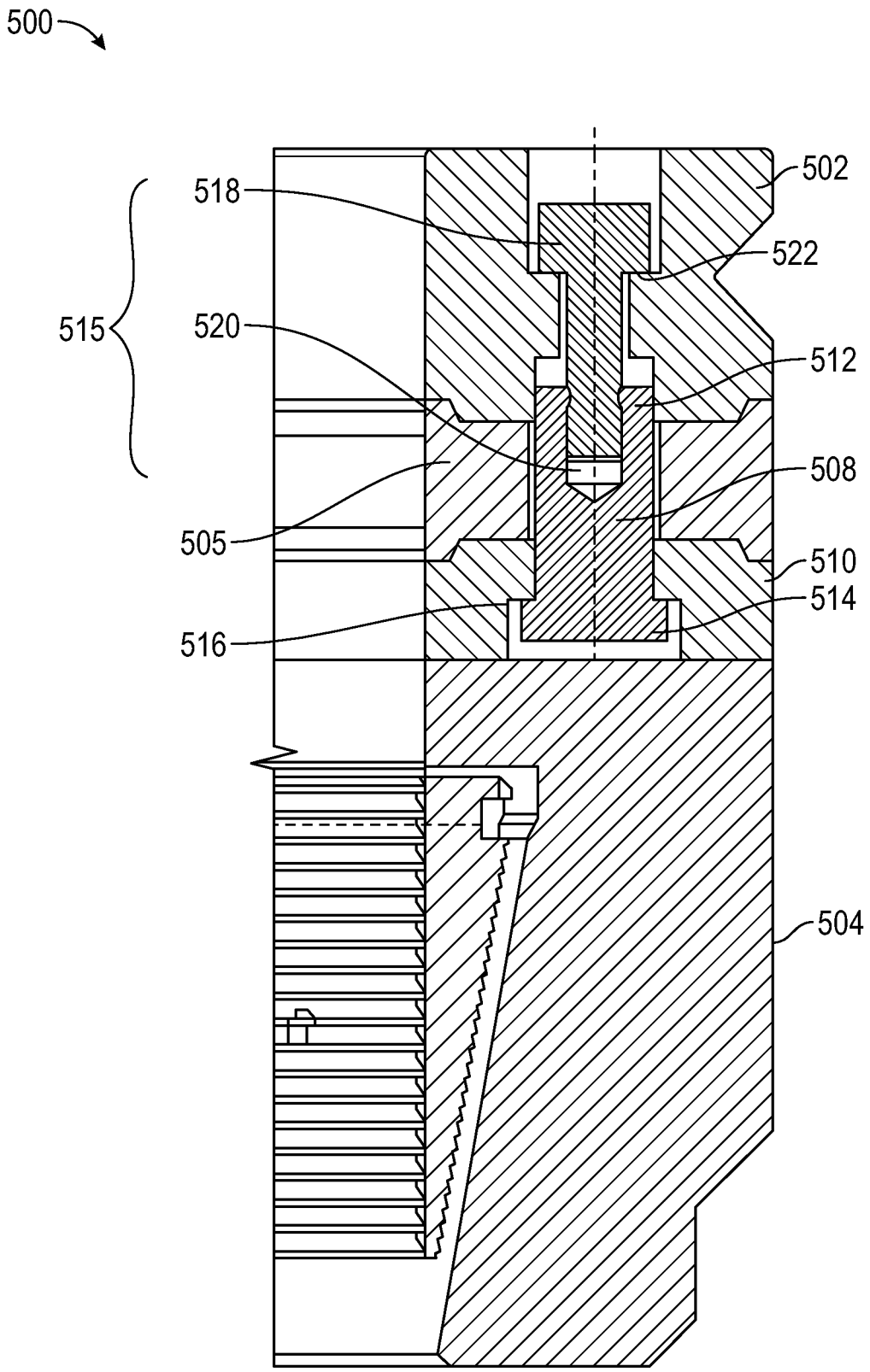
FIG. 5A shows partial cross-sectional view of a casing hanger apparatus in accordance with one or more embodiments.

Referring now to FIG. 5A, in one or more embodiments, a slip-style casing hanger 500 contains at least one BPI pin 508 assembled in the casing hanger using a bushing member 510. The casing hanger 500 contains at least two ring members, including a lower ring 504, an upper ring 502, and the bushing member 510. The lower ring 504 is located at a position nearer to the opening of the well (e.g., 104 in FIG. 1) compared to the upper ring 502 when installed in a wellhead (e.g., 101 in FIG. 1), and the bushing member 510 is positioned axially between the upper and lower rings 502, 504. Each of the upper ring 502, lower ring 504, and bushing member 510 may have an annular shaped body extending angularly around the casing hanger 500.

The casing hanger 500 also contains a packing element 505 positioned axially between the upper ring 502 and the bushing member 510, where the packing element 505 also has an annular shaped body. In the embodiment shown, the bushing member 510 is positioned axially adjacent to the lower ring 504, but in other embodiments, the relative axial positions of the packing element 505 and bushing member 510 may be switched, such that the bushing member is axially adjacent to the upper ring.

In one or more embodiments, multiple BPI pins 508 may be assembled within the packing element 505 and bushing member 510 in an angularly spaced configuration around the annular distance of the casing hanger 500. Each BPI pin 508 includes a female end 512 and a male end 514 at opposite axial ends. In one or more embodiments, each BPI pin 508 assembled in a casing hanger may be identical.

When assembled, the male end 514 of each BPI pin 508 extends through a bushing hole formed through the bushing member 510 and may be axially retained to the bushing member 510 via at least one interlocking feature. In the embodiment shown, interlocking features includes a relatively large diameter head formed at the male end 514 of the BPI pin and a bushing seat 516 formed along the bushing hole, where the bushing seat 516 has an inner diameter larger than the bushing hole diameter. With such configuration, the bushing seat 516 is configured to fit and axially retain the head of the male end 514 of the pin member 508. One skilled in the art may appreciate that other interlocking geometries may be used to axially retain a BPI pin 508 to a bushing member 510.

The female end 512 of each BPI pin 508 may be connected to the upper ring 502 via a bolt member 515. For example, as shown in FIG. 5A, the bolt member 515 has a base end 518 and a tip end 520. When assembled, the bolt member 515 extends through a hole formed through the upper ring 502, and the tip end 520 of the bolt member 515 is threaded to the female end 512 of the BPI pin 508. The base end 518 of the bolt member 515 has a relatively large diameter head that fits within an upper seat 522 formed along the upper ring hole, such that the base end 518 of the bolt member 515 is axially retained by the upper seat 522.

The BPI pin 508 and bolt member 515 of FIG. 5A are movable in two directions: in a first axial direction, which is from the upper ring 502 towards the lower ring 504, and in an opposite, second axial direction which is towards the upper ring 502. When pressure is applied in the first axial direction (from the upper ring 502 towards the lower ring 504), the BPI pin 508 and threadedly connected bolt member 515, are pushed towards the lower ring 504. In this instance, the bolt member 515 absorbs the load generated by the applied pressure and the load is transferred to the upper seat 522 (and thus upper ring 502) and subsequently to the packing element 505, where the pressure is intensified at the packing element 505.

When pressure is applied in the second axial direction (from the lower ring 504 towards the upper ring 502), the BPI pin 508 and threadedly connected bolt member 515 are pushed towards the upper ring 502. The BPI pin 508 absorbs the load generated by the applied pressure and the load is transferred to the bushing seat 516 of the bushing member 510. The load is subsequently transferred to the packing element 505, where the pressure is thereby intensified at the packing element 505.

Figure 5B:
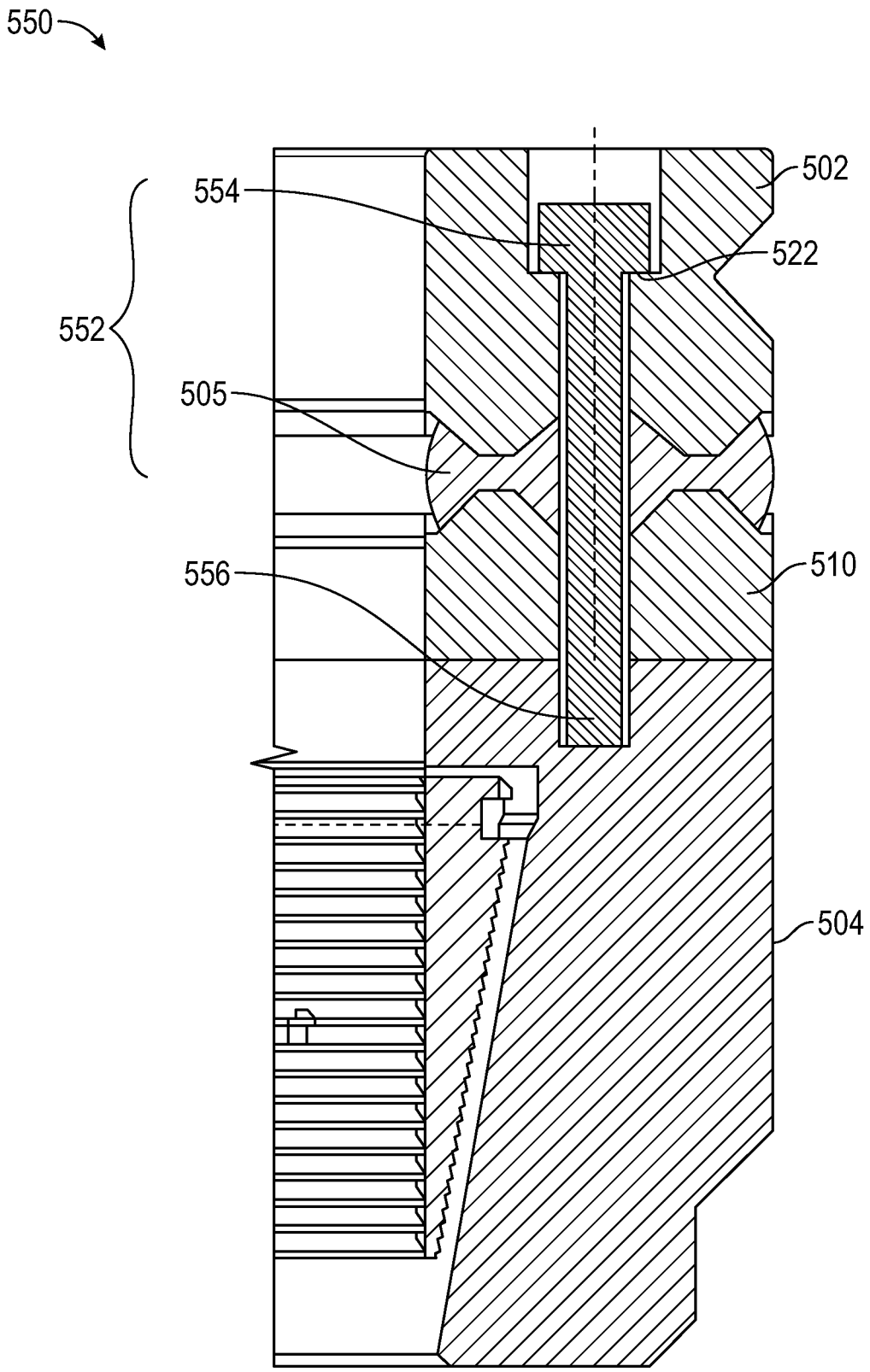
FIG. 5B shows another partial cross-sectional view of a casing hanger apparatus in accordance with one or more embodiments.

In one or more embodiments, the busing member may be connected to the lower ring by separate fasteners, such as a bolt. FIG. 5B shows a cross-section 550 of another portion of the casing hanger of FIG. 5A, where a bolt 552 secures the lower ring 504 to the bushing member 510. The bolt 552 has a base 554 and a tip 556 and extends from the upper ring 502 through the packing element 505, the bushing member 510 and into the lower ring 504. When secured into the casing hanger 550, the bolt 552 tip 556 sits in a cavity of the lower ring 504 and the bolt 552 base 554 is seated on an upper seat 522 of the upper ring 502.

Although only a few example embodiments have been described in detail above, those skilled in the art will readily appreciate that many modifications are possible in the example embodiments without materially departing from this invention. Accordingly, all such modifications are intended to be included within the scope of this disclosure as defined in the following claims.

What is claimed:

1. An apparatus, comprising:
a casing hanger, comprising;
at least two rings, comprising,
an upper ring; and
a lower ring; and
a packing element, comprising a wedge-shaped cross-sectional geometry and extending annularly between the upper ring and the lower ring,
bi-directional pressure intensification (BPI) pins arranged around the casing hanger in an angularly spaced apart configuration, wherein the BPI pins extend axially from the upper ring through holes in the packing element to the lower ring, and
multiple bolt members, each bolt member threaded to a female end of the BPI pins.

2. The apparatus of claim 1, wherein the at least two rings comprise at least two radial splits forming separate members, wherein the separate members are positioned around a well casing such that the at least two rings extend around the well casing.

3. The apparatus of claim 1, wherein the packing element comprises at least one radial split.

4. The apparatus of claim 1, wherein every other of the BPI pins are positioned in alternating axial directions, wherein in a first axial direction, a female end faces the upper ring, and in a second axial direction, the female end faces the lower ring.

5. The apparatus of claim 1, wherein the wedge-shaped cross-sectional geometry comprises:
a neck extending between an outer wedged side and an inner wedged side;
the outer wedged side, comprising:
an outer surface defining an outer diameter of the packing element;
an outer height measured between an upper surface and a lower surface; and
outer sloped transition surfaces extending from the upper surface and the lower surface to the neck; and
the inner wedged side, comprising:
an inner surface defining an inner diameter of the packing element;
an inner height measured between the upper surface and the lower surface; and
inner sloped transition surfaces extending from the upper surface and the lower surface to the neck.

6. The apparatus of claim 5, wherein the upper ring has a lower surface geometry corresponding with the upper surface of the packing element, and wherein the lower ring has an upper surface geometry corresponding with the lower surface of the packing element.

7. The apparatus of claim 5, wherein the neck has bosses formed around the holes of the packing element.

8. An apparatus, comprising:
a casing hanger, comprising;
at least two rings, wherein the at least two rings comprises:
an upper ring; and
a lower ring;
at least one bi-directional pressure intensification (BPI) pin arranged around the casing hanger and extending axially between the upper ring and the lower ring, each BPI pin comprising a male end and a female end, wherein the female end is affixed to one of the at least two rings by a bolt member;
a bushing member positioned axially between the upper ring and the lower ring,
wherein the male end of each BPI pin extends through a bushing hole formed in the bushing member, and
wherein the male end of each BPI pin comprises an interlocking feature configured to axially retain each BPI pin to the bushing member; and
a packing element, comprising a wedge-shaped cross-sectional geometry and extending annularly between the upper ring and the bushing member,
wherein each BPI pin extends axially through the bushing member and the packing element.

9. The apparatus of claim 8, wherein the at least two rings comprise at least two radial splits forming separate members, such that the at least two rings are positioned around a well casing.

10. The apparatus of claim 8, wherein the packing element comprises at least one radial split, wherein the packing element is positioned around a well casing such that the packing element extends around the well casing.

11. The apparatus of claim 8, wherein the bushing member comprises a lower seat configured to fit the male end of the at least one BPI pin.

12. The apparatus of claim 8,
wherein the bolt member comprises a base end and a tip end threaded to the female end of the at least one BPI pin; and
wherein the base end of the bolt member is fitted in an upper seat formed in the upper ring.

13. The apparatus of claim 8, wherein the wedge-shaped cross-sectional geometry comprises:
a neck extending between an outer wedged side and an inner wedged side;
the outer wedged side, comprising:
an outer surface defining an outer diameter of the packing element;
an outer height measured between an upper surface and a lower surface; and
outer sloped transition surfaces extending from the upper surface and the lower surface to the neck; and
the inner wedged side, comprising:
an inner surface defining an inner diameter of the packing element;

an inner height measured between the upper surface and the lower surface; and inner sloped transition surfaces extending from the upper surface and the lower surface to the neck.

14. The apparatus of claim 13, wherein the outer wedged side is symmetric to the inner wedged side.

15. The apparatus of claim 8, further comprising a fastener connecting the bushing member to the lower ring.

16. An apparatus, comprising:

a casing hanger, comprising;

at least two rings, comprising, an upper ring; and a lower ring; and a packing element, comprising a wedge-shaped cross-sectional geometry and extending annularly between the upper ring and the lower ring, a first set of bi-directional pressure intensification (BPI) pins arranged around the casing hanger in an angularly spaced apart configuration and oriented in a first axial direction, wherein each of the first set of BPI pins comprise:

a male end axially retained in an upper ring cavity, such that when an upper load is applied to the upper ring, the upper load is transferred through the BPI pin; and a female end having a cylindrical outer profile and inserted in a lower ring cavity, such that when the upper load is transferred through the BPI pin, the upper load is not transferred to the lower ring, wherein each of the first set of BPI pins extend axially from the upper ring through holes in the packing element to the lower ring.

17. The apparatus of claim 16, further comprising:

a second set of BPI pins arranged in an alternating pattern with the first set of BPI pins around the casing hanger, wherein the second set of BPI pins are oriented in a second axial direction opposite the first axial direction, and wherein each of the second set of BPI pins comprise:

a second male end axially retained in a second lower ring cavity, such that when a lower load is applied to the lower ring, the lower load is transferred through the BPI pin; and a second female end having a cylindrical outer profile and inserted in a second upper ring cavity, such that when the lower load is transferred through the BPI pin, the lower load is not transferred to the upper ring.

18. The apparatus of claim 17, wherein the first set of BPI pins and the second set of BPI pins have identical construction.

19. The apparatus of claim 16, further comprising bolts, each bolt extending through the lower ring and threaded to the female end of each of the first set of BPI pins.

* * * * *